US006229492B1

(12) United States Patent
Lee et al.

(10) Patent No.: US 6,229,492 B1
(45) Date of Patent: May 8, 2001

(54) ANTENNA DEVICE FOR AUTOMOTIVE VEHICLE

(75) Inventors: Yong Ho Lee; Byung Yong Sung, both of Seoul (KR)

(73) Assignee: Poong Jeong Industrial Co., Ltd., Puchon (KR)

( * ) Notice: Subject to any disclaimer, the term of this patent is extended or adjusted under 35 U.S.C. 154(b) by 0 days.

(21) Appl. No.: 09/367,450

(22) PCT Filed: Feb. 16, 1998

(86) PCT No.: PCT/KR98/00029

§ 371 Date: Aug. 16, 1999

§ 102(e) Date: Aug. 16, 1999

(87) PCT Pub. No.: WO98/36469

PCT Pub. Date: Aug. 20, 1998

(30) Foreign Application Priority Data

Feb. 18, 1997 (KR) ..... 97-4869

(51) Int. Cl.[7] ..... H01Q 1/32

(52) U.S. Cl. ..... 343/713; 343/867

(58) Field of Search ..... 343/713, 711, 343/712, 714, 753, 756, 787, 788, 866, 867, 704

(56) References Cited

U.S. PATENT DOCUMENTS

| | | | | |
|---|---|---|---|---|
| 4,760,394 | | 7/1988 | Takeuchi et al. | 340/825 |
| 5,231,408 | * | 7/1993 | Nakase | 343/713 |
| 5,504,478 | | 4/1996 | Knapp | 340/825 |
| 5,581,264 | * | 12/1996 | Tabata et al. | 343/713 |
| 5,999,134 | * | 12/1999 | Dishart et al. | 343/713 |
| 6,008,766 | * | 12/1999 | Maedae et al. | 343/713 |

FOREIGN PATENT DOCUMENTS

| | | |
|---|---|---|
| 2425189 | 12/1974 | (DE) . |
| 0540899 | 5/1993 | (EP) . |

* cited by examiner

*Primary Examiner*—Don Wong
*Assistant Examiner*—Thuy Vinh Tran
(74) *Attorney, Agent, or Firm*—Jacobson, Price, Holman & Stern, PLLC

(57) ABSTRACT

The present invention presents an antenna device for an automotive vehicle wherein a first coil is installed horizontally to receive radio signals. Capacitors are connected electrically and in parallel with the first coil. A second coil is connected electrically with the first coil and installed horizontally under the first coil. A third coil is connected electrically between the first coil and the ground and installed horizontally under the first coil. Additionally, a fourth coil is connected electrically between the first coil and the second coil and installed vertically under the first coil. This antenna device, now including the first to the fourth coils and capacitors, is installed in a mirror case for the car.

13 Claims, 4 Drawing Sheets

ANTENNA DEVICE FOR AUTOMOTIVE VEHICLE

BACKGROUND OF THE INVENTION

1. Field of the Invention

The present invention relates to an antenna device for an automotive vehicle. More particularly, it relates to an antenna device for automotive vehicle, in which the antenna and accompanying elements are installed inside a mirror case for the automotive vehicle, thereby obviating the problem that the antenna is curved by air resistance and increasing reception sensitivity level of radio signals.

2. Description of the Prior Art

Generally, the car has an audio system for providing the driver with information about traffic conditions and comfortable environment. Nowadays, the audio system is installed in a car as a basic part. Drivers can listen to music or news through the car audio system. They can avoid boring conditions due to long drives and select the optimal driving course referring to the traffic news information.

The audio system requires an antenna to receive radio signals. The dipole antenna is generally installed on the outside of the car and driven by an electric motor.

In this conventional dipole antenna, however, there are the problems that the antenna is curved by air resistance when the car is driving at a high speed and reception sensitivity level of radio signals is lowered.

To solve the problems, an antenna installed in the windshield glass of the car in the form of the pattern is provided. Because the antenna made of copper or silver paster is patterned and formed in the windshield glass, it can not be bent by the wind during the drives.

The antenna formed in the windshield glass has a problem that static electricity produced by friction between the wind and windshield glass is acting as electrical noises thereby the quality of the reception signal is degraded.

SUMMARY OF THE INVENTION

Therefore the object of the present invention is to provide an antenna device for an automotive vehicle, in which an antenna and accompanying elements are installed in a side-view mirror case or a rearview mirror case, thereby obviating the problem that the antenna is curved by air resistance when the car is driving.

The another object of the present invention is to provide an antenna device for an automotive vehicle, in which reception sensitivity level of radio signals is increased by arranging several antennas in vertical and horizontal direction according to the electomagnetive radio wave signals.

The above object has been achieved by the present invention, which provides an antenna device for an automotive vehicle comprising:

a first coil installed horizontally to receive radio signals, capacitors connected with the first coil in electrical parallel, a second coil connected electrically with the first coil and installed horizontally under the first coil, a third coil connected electrically between the first coil and the ground and installed horizontally under the first coil, and a fourth coil connected electrically between the first coil and the second coil and installed vertically under the first coil, and characterizing that from the first to the fourth coils and capacitors are installed in a mirror case for the automotive vehicle.

Further, according to the present invention, an antenna device for an automotive vehicle is provided, comprising:

a power source for supplying the electricl power;

an antenna for receiving radio signals by means of a cored coil;

a band pass filter for permitting a certain frequency range component of the received signals from the antenna to pass through;

an amplifier for amplifying the filtered signal from the band pass filter;

and characterizing that the antenna, the band pass filter and the amplifier are installed in a mirror case for the automotive vehicle.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain in the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
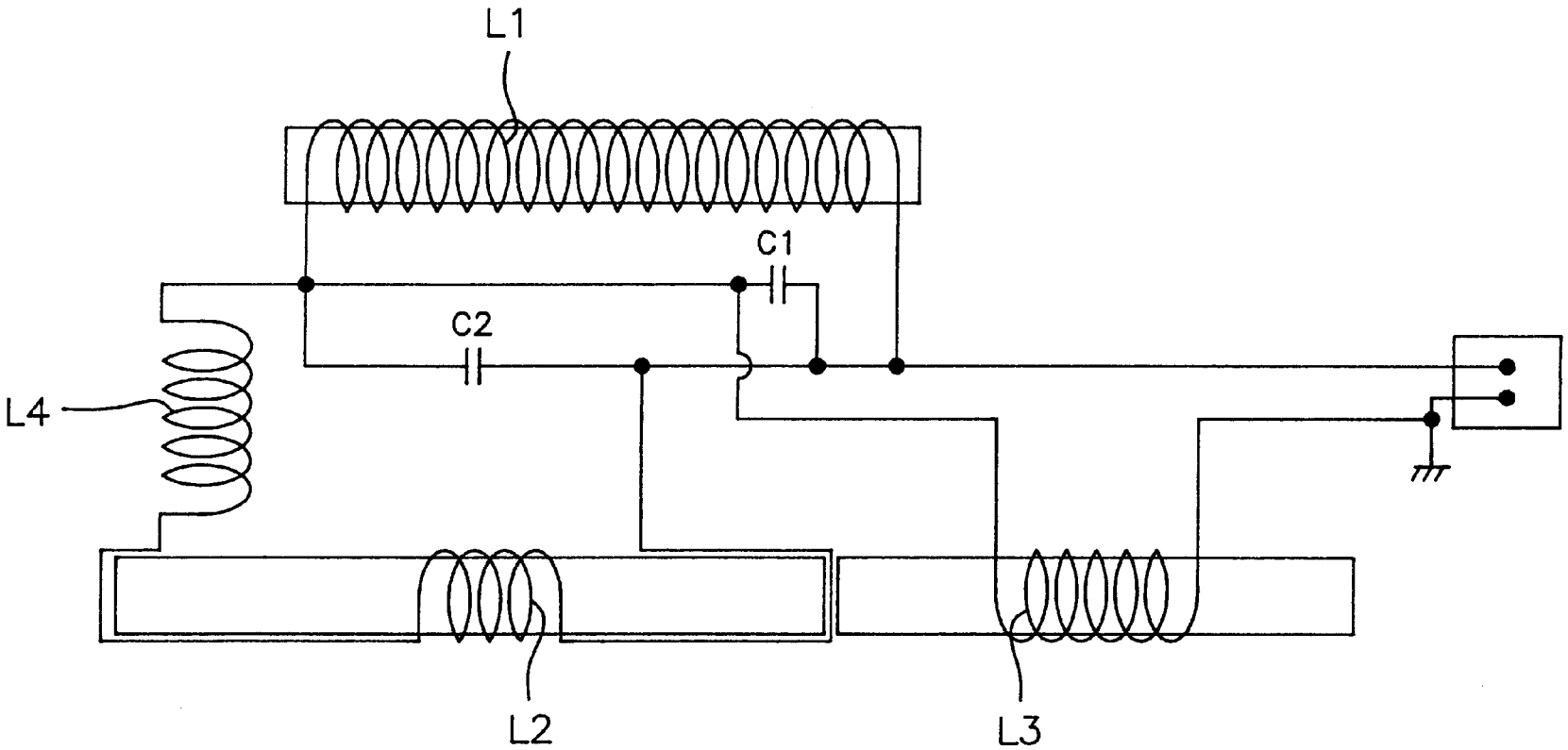
FIG. 1 is a circuit diagram of an antenna device for automotive vehicle according to the present invention.
Figure 2:
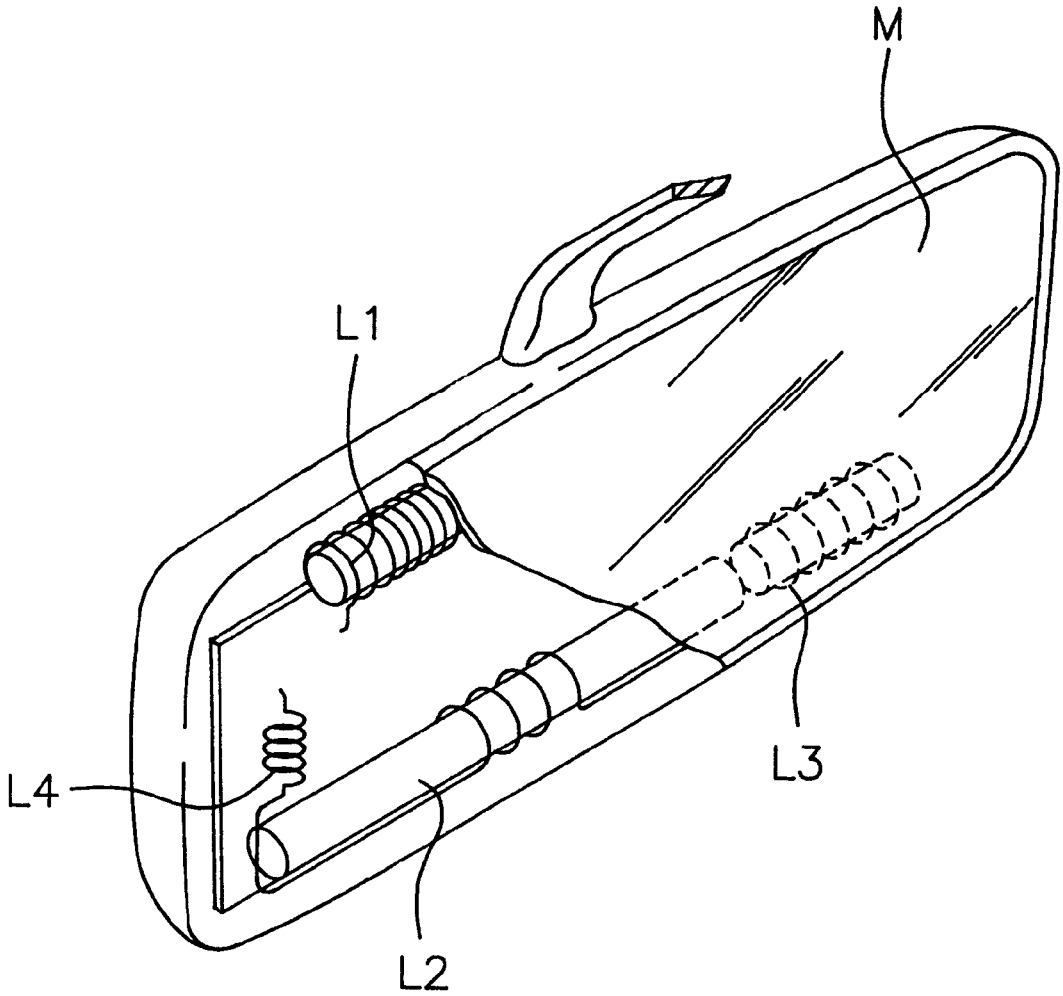
FIG. 2 is a partial cross-sectional view where the antenna device is established in a rear-view mirror according to the present invention.

Referring now to FIG. 1 and FIG. 2, there is shown the antenna device according to the first embodiment of the present invention.

The first coil L1 is installed horizontally inside a rearview mirror case M. The capacitors C1 and C2 are respectively connected with the first coil L1 in electrical parallel. The second coil L2 is connected electrically with the first coil L1 and installed horizontally under the first coil L1. The third coil L3 is connected electrically between the first coil L1 and the ground and installed horizontally under the first coil L1. The fourth coil L4 is connected electrically between the first coil L1 and the second coil L2 and installed vertically under the first coil L1. The first coil L1, the second coil L2, the third coil L3, the fourth coil L4 and the capacitors C1 and C2 are installed in a mirror case M.

All elements inside the mirror case M is fixed on a printed circuit board and the output terminal of the printed circuit board is connected to a receiving apparatus such as the audio system via a coaxial cable.

The following description relates to the operation of the antenna device according to the first embodiment of the present invention.

When the audio system is powered on, the induced currents are produced in the coils L1 to L4 by the radio broadcasting signal and flow through the coils L1 to L4. The coil antenna can receive the radio broadcasting signal inductively whereas the dipole antenna should contact with the radio signal to receive it.

Intensity of the received signal through the-coils L1 to L4 varies in accordance with the kind of core which is rolled by the coil. In the present invention, ferrite, a magnet or a copper pipe can be used as the core.

The signal received by the coils L1 to L4 is transferred to a receiving apparatus such as the audio system through a coaxial cable, thereby the receiving apparatus comes into action.

The performance of the antenna device according to the first embodiment of the present invention can be verified by a numerical expression as follows.

When the antenna is formed of a coil with ferrite bar core which has a radius $\alpha$, large permeability and turns N, the receiving voltage Voc in AM area is given like the following.

$$Voc=-jw\mu_e\mu_o N\pi\alpha^2 Hi=-j(2\pi/\lambda_o)\mu_e N\pi\alpha^2 \mathrm{Ei}$$

When the length of the ferrite bar core is very large in comparison with the radius $\alpha$ and permeability is very large over 1, the effective permeability $\mu_e$ is obtained like the following.

$$\mu_e=(1/a^2)/(\ln(2l/\alpha)-1)$$

In the case, the radiating resistance Ra of the antenna is as follows.

$$Ra=320\pi^6(\gamma_o/\lambda_o)^4 N^2 \mu^2{}_e$$

Therefore, when $\gamma_o$ equals 0.5 cm, N equals 100 and $(l/\alpha)$ equals 100, Ra equals 0.0013Ω and Xa is highly capacitive as the impedance of the antenna at 1 MHz.

From above evaluation, it can be found that the antenna device according to the present invention is of good performance in comparison with the dipole antenna.

From now on, the following explanation relates to the second embodiment of the present invention.

Figure 3:
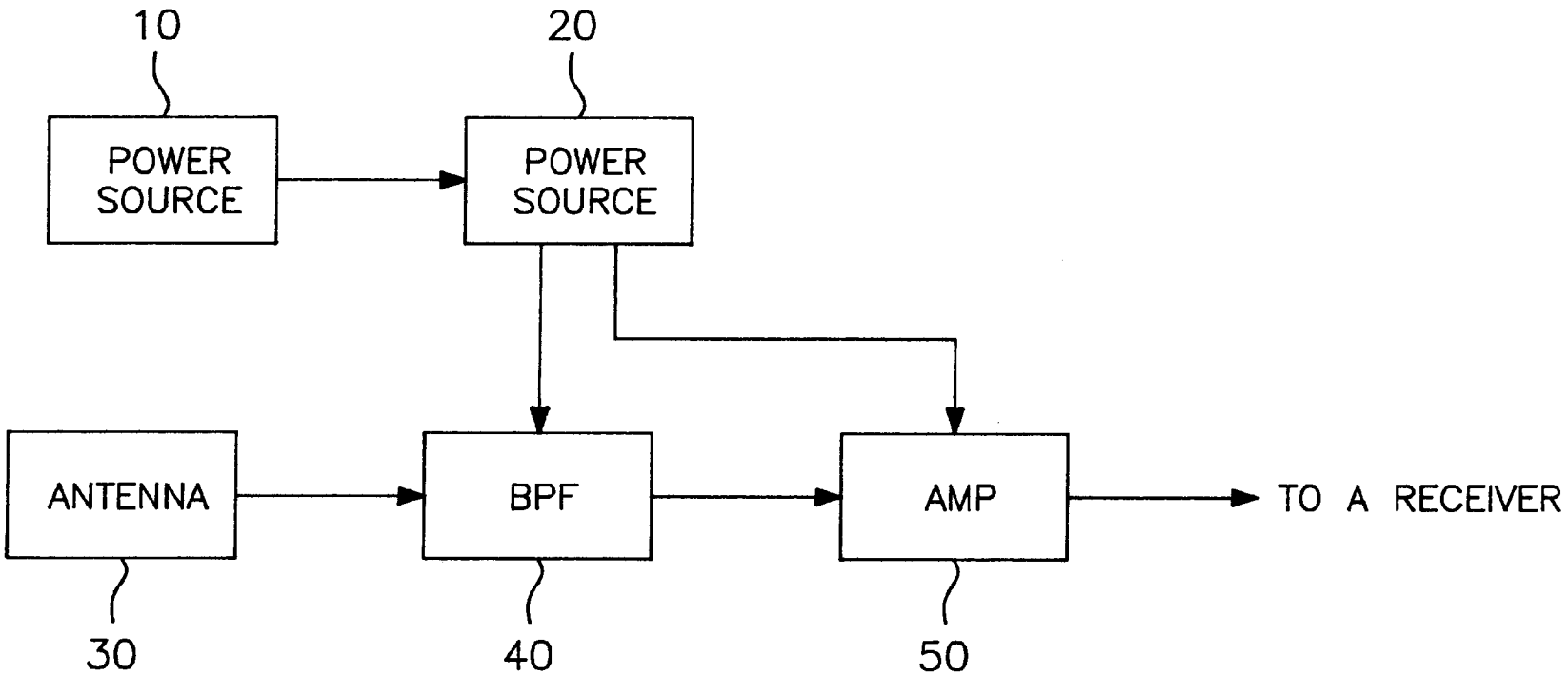
FIG. 3 is a block diagram of an antenna device for automotive vehicle according to another embodiment of the present invention.
Figure 4:
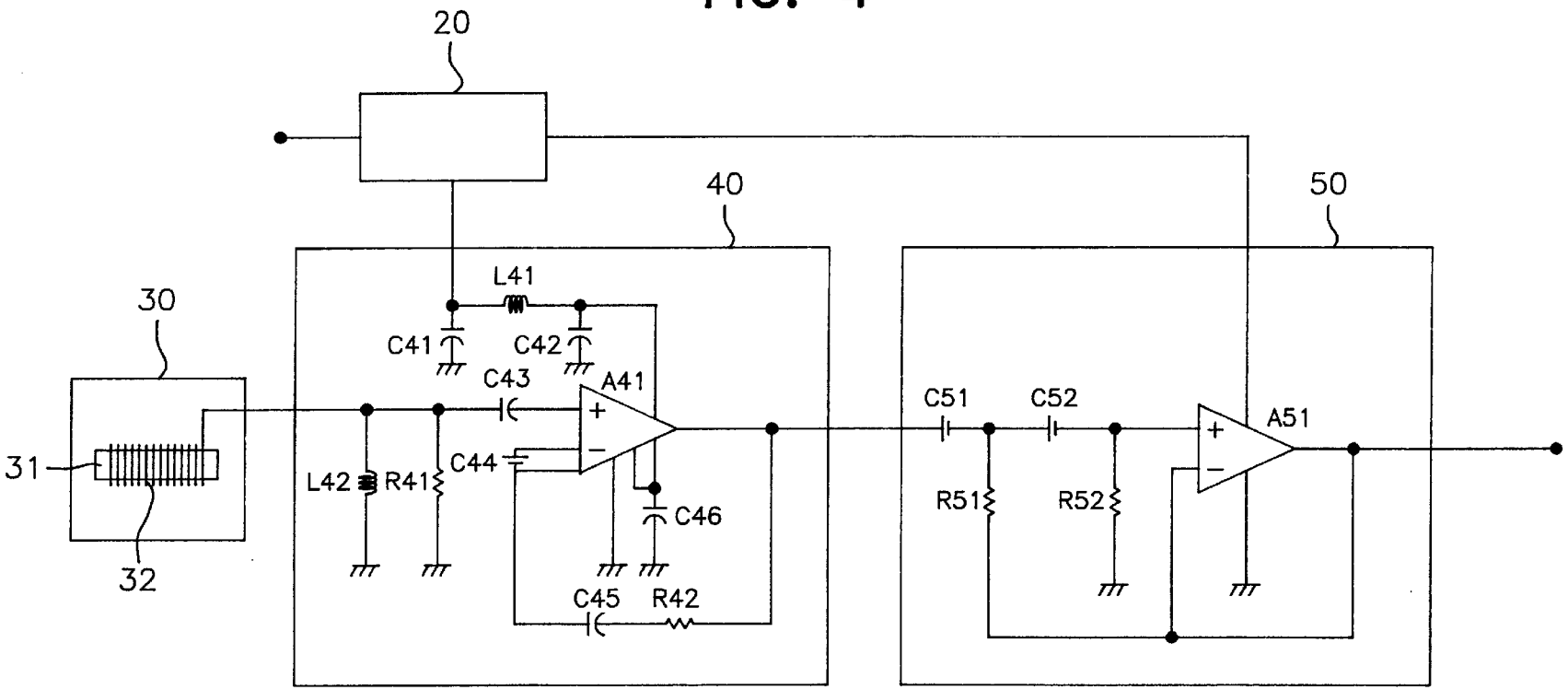
FIG. 4 is a circuit diagram of the antenna device according to another embodiment of the present invention.

Referring to FIG. 3 and FIG. 4, there is shown the antenna device according to the second embodiment of the present invention.

The power source 10 supplies electric energy. As the power source 10, a small battery cell or a storage battery for the car can be used. The power filter 20 is connected to the power source 10 and filters off electrical noises.

The antenna 30 comprises core 31 and the coil 32 wound on the core 31. Ferrite, a magnet or a copper pipe can be used as the core 31.

The power filter 20 and the antenna 30 are connected to the band pass filter 40. The band pass filter 40 includes the capacitor C41 connected between the output terminal of the power filter 20 and the ground, the coil L41 connected with the output terminal of the filter 20, the capacitor C42 connected between the coil L41 and the ground, the coil L42 connected between the output terminal of the antenna 30 and the ground, the resistor R41 connected between the out put terminal of the antenna 30 and the ground, the capacitor C43 connected with the output terminal of the antenna 30, the operational amplifier A41 connected with the capacitor C43, the capacitor C44 connected with the input terminal of the operational amplifier A41, the capacitor C45 connected to the input terminal of the operational amplifier A41 the resistor R42 connected between the capacitor C45 and the output terminal of the operational amplifier A41, and the capacitor C46 connected between the operational amplifier A41 and the ground.

The power filter 20 and the band pass filter 40 are connected to the amplifier 50. The amplifier 50 comprises the capacitor C51 connected with the output terminal of the band pass filter 40, the capacitor C52 connected with the capacitor C52, the resistor R51 connected with the capacitor C52, the resistor R52 connected between the capacitor C52 and the ground, and the operational amplifier A51 connected with the capacitor C52.

The antenna 30, the band pass filter 40 and the amplifier 50 are installed in the mirror case for the automotive vehicle. All elements inside the mirror case is fixed on a printed circuit board, and the input and output of the printed circuit board is connected to a receiving appratus like the audio system through a coaxial cable.

The following description relates to the operation of the antenna device according to the second embodiment of the present invention.

When a power switch of the audio system turns on, the power source 10 is electrically connected with the power filter 20. The power source supplies the electrical power signal for the power filter 20. The power filter 20 eliminates noises from the power signal. Then, the power filter 20 applies the filtered power signal to the band pass filter 40 and the amplifier 50. When the filtered power signal is applied to the band pass filter 40 and the amplifier 50, they start to work.

In the meantime, the induced currents are produced in the antenna 30 by the radio broadcasting signal and applied to the band pass filter 40. The antenna 30 can receive the radio broadcasting signal inductively whereas the dipole antenna should contact with the radio signal to receive it. Intensity of the received signal through the antenna 30 varies in accordance with the kind of core 31.

The band pass filter 40 permits a certain frequency range component of the signals from the antenna 30 to pass through. The amplifier 50 amplifies the signal from the band pass filter 40, then applies the amplified signal to the audio sytem.

Because the antenna 30, the band pass filter 40 and the amplifier 50 are installed in a mirror case for the car, there is no problem such as the bend due to air resistance during the drives.

As described above, an antenna device where an antenna and accompanying elements are installed in a sideview mirror case or a rearview mirror case is provided. According to the present invention, the antenna device can be prevented from curving due to air resistance when the car is driving, and reception sensitivity of the antenna device can be increased.

It will be apparent to those skilled in the art that various modifications and variations can be made in an antenna device for an automotive vehicle of the present invention without departing from the scope and sprit of the invention. Thus it is intended that the present invention cover the modifications and variations of this invention provided they come within the scope of the appended claims and their equivalents.

What is claimed is:

1. An antenna device for an automotive vehicle comprising:

a first coil installed horizontally to receive radio signals;

capacitors connected with the first coil in electrical parallel;

a second coil connected electrically with the first coil and installed horizontally under the first coil;

a third coil connected electrically between the first coil and a ground and installed horizontally under the first coil;

a fourth coil connected electrically between the first coil and the second coil and installed vertically under the first coil;

cores rolled by the coils respectively; and a printed circuit board to fix and connect all elements physically and electrically;

wherein said coils, capacitors, cores, and the printed circuit board are packed in a mirror case for the automotive vehicle.

2. The device as set forth in claim 1, wherein the core is ferrite.

3. The device as set forth in claim 1, wherein the core is the magnet.

4. The device as set forth in claim 1, wherein the core is the copper pipe.

5. The device as set forth in claim 1, wherein the mirror is the rearview mirror.

6. The device as set forth in claim 1, wherein the mirror is the sideview mirror.

7. An antenna device for an automotive vehicle comprising:

a power source for supplying the electrical power;

an antenna for receiving radio signals by means of a cored coil;

a band pass filter using an operational amplifier for permitting a certain frequency range component of the received signals from the antenna to pass through;

an amplifier for amplifying the filtered signal from the band pass filter; and a printed circuit board to fix and connect all elements physically and electrically;

wherein the antenna, the band pass filter, the amplifier, and the printed circuit board are installed in a mirror case for the automotive vehicle.

8. The device as set forth in claim 7, where in the antenna includes a core and the coil wound.

9. The device as set forth in claim 8, wherein the core is ferrite.

10. The device as set forth in claim 8, wherein the core is the magnet.

11. The device as set forth in claim 8, wherein the core is the copper pipe.

12. The device as set forth in claim 7, wherein the mirror is the rearview mirror.

13. The device as set forth in claim 7, wherein the mirror is the sideview mirror.

* * * * *